US006796680B1

(12) United States Patent
Showers et al.

(10) Patent No.: US 6,796,680 B1
(45) Date of Patent: Sep. 28, 2004

(54) STRIP LIGHTING

(75) Inventors: David Field Showers, Victoria (AU); James Berry Quantrell, Victoria (AU); Kenneth Robert Goddard, Victoria (AU); Malcolm Wesley Oldis, Victoria (AU)

(73) Assignee: Lumileds Lighting U.S., LLC, San Jose, CA (US)

( * ) Notice: Subject to any disclaimer, the term of this patent is extended or adjusted under 35 U.S.C. 154(b) by 0 days.

(21) Appl. No.: 09/493,119

(22) Filed: Jan. 28, 2000

(51) Int. Cl.[7] ..... F21V 5/00
(52) U.S. Cl. ..... 362/246; 362/249; 362/240
(58) Field of Search ..... 362/246, 249, 362/146, 152, 223, 225, 363, 367, 368, 145, 219, 240, 239, 252, 800; 439/631, 328

(56) References Cited

U.S. PATENT DOCUMENTS

| | | | | |
|---|---|---|---|---|
| 3,894,225 A | | 7/1975 | Chao | |
| 4,376,966 A | | 3/1983 | Tieszen | |
| 4,434,455 A | * | 2/1984 | Merritt | 362/307 |
| 4,482,944 A | * | 11/1984 | Roossine et al. | 362/418 |
| 4,761,720 A | | 8/1988 | Solow | |
| 4,994,944 A | * | 2/1991 | Vernondier | 362/238 |
| 5,161,882 A | | 11/1992 | Garrett | |
| 5,404,279 A | * | 4/1995 | Wood | 362/145 |
| 5,707,136 A | * | 1/1998 | Byers | 362/145 |
| 5,765,938 A | * | 6/1998 | Rousso et al. | 362/198 |
| 6,183,104 B1 | * | 2/2001 | Ferrara | 362/145 |

FOREIGN PATENT DOCUMENTS

| | | |
|---|---|---|
| JP | 09258676 | * 10/1997 |
| WO | WO 88/01360 | 2/1988 |

* cited by examiner

*Primary Examiner*—Thomas M. Sember
*Assistant Examiner*—B Q. T
(74) *Attorney, Agent, or Firm*—Patent Law Group LLP

(57) ABSTRACT

A strip lighting device includes an elongate housing, a plurality of light sources arranged at intervals within the housing, and a fastener for fastening the elongate housing to a surface. The elongate housing overlies the plurality of light sources and diffuses, disperses or scatters light from the light sources such that individuals of the plurality of light sources are substantially not distinguishable when the housing is viewed from the outside.

24 Claims, 16 Drawing Sheets

STRIP LIGHTING

RELATED APPLICATIONS

This application is a continuation of International Application No. PCT/AU98/00602, with an international filing date of Jul. 28, 1998, published in English on Feb. 11, 1999, and incorporated herein by reference. International Application No. PCT/AU98/00602 claims priority to AUPO8240 filed Jul. 28, 1997; AUPP2590 filed Mar. 26, 1998; and AUPP3229 filed Apr. 29, 1998.

FIELD OF INVENTION

This invention relates to light sources and to lighting systems, and has a particularly advantageous application to the decorative illumination of structures and structural elements. The invention is especially effective when employed with LEDs as light sources, although it is emphasised that broader applications are encompassed.

BACKGROUND ART

British patent publication 2102933 discloses a lighting display configuration made up of multiple transparent polycarbonate or plastics tubes linked by socket units with several differently oriented recesses to seat the tubes. Each of the tubes contains an array of light bulbs, filament lamps or light emitting diodes (LED). The application illustrates a free standing framework of the tubes and linking socket units.

A known lighting product in strip form has a linear array of well-spaced LED chips in a close-fitting coloured plastics tube of rectangular cross-section. The tube is a little less than 1 cm in width and each LED chip is visible from the exterior both when not activated and as an individual point of light. The product is used to provide low light level safety lighting, eg., as a front edge "night light" marker for steps and stairways, and thus the rectangular tube is a protective carrier housing for the low light level LED marker lamps.

Another known product has small incandescent light bulbs embedded at intervals in an axial plane in a solid cylinder of plastics material. The bulbs are arranged as series sets in parallel, electrically connected across a pair of longitudinally extending wires also embedded in the cylinder. Each bulb stands out individually when the device is activated, so that the cylinder of plastics material effectively serves as a carrier forming a chain of spaced incandescent bulbs.

SUMMARY OF THE INVENTION

The present applicant has appreciated that a light tube structure in which multiple light emitting diodes are arranged within an elongated translucent tube, provides a wide variety of opportunities for novel strip lighting of structures such as playgrounds and the walls and roofs of commercial premises including restaurants. This opportunity is further enhanced by the recent availability of light emitting diodes of substantially enhanced luminance relative to conventional devices, and of multi-colour LED devices.

In one respects the invention is concerned with the decoration or highlighting of features of structures. In another respect, the invention provides for the fixing of translucent housings containing spaced LEDs on wall or frame surfaces of a wide variety of structures.

The invention provides a strip lighting device which includes:

an elongate housing that is at least partially translucent;

a multiplicity of light sources arranged at intervals within said housing; and means to diffuse, disperse or scatter light from said light sources whereby on activation of the light sources, a visible optical effect is produced when the housing is viewed from the outside.

In a particular application, the invention is directed to a structure having one or more features highlighted or decorated by one or more of the above-described strip lighting devices.

Preferably, the highlighted or decorated feature of the structure is a corner or edge, for example an edge of a roof, a window or a door, or a corner between respective wall or roof sections. A particularly effective application is to a gable or ridge line of a building roof. The strip lighting device(s) may be mounted along the edge or corner, or adjacent to but offset from the edge or corner.

The housing of the strip lighting device may be substantially white, but is preferably a colour other than white. In one application of the invention, the structure is a commercial building and the color of the or each housing is chosen to match or complement the colour(s) of identification or trade mark signage displayed on the building.

The highlighted or decorated feature may alternatively be, e.g., a post, a rail or a border.

There may be mounting means that includes a mounting rail adapted to be fastened to said surface, and cooperable means on the strip and the housing for effecting a snap or sliding engagement of the housing to the strip so that the housing is generally parallel to, and preferably overlies, the strip.

The light sources are preferably light emitting diodes or other low voltage or semiconductor devices.

The invention further provides, in a third aspect, a housing assembly for strip lighting, including:

an elongate housing at least partly but preferably substantially wholly of a translucent material;

a mounting rail; and co-operable longitudinally extending formations on the rail and the housing for effecting a snap or sliding engagement of the housing to the rail so that the housing is generally parallel to, and preferably overlies, the strip.

The snap or sliding engagement may be achieved between longitudinally extending rib means on one of the components, preferably the strip, and complementary groove moans on the other. There may be opposed longitudinal undercut formations in the groove means.

The strip conveniently includes a substantially planar rear engagement with the respective surface to which it is fastened.

Preferably, in all of the aforementioned as of the invention, the outer or front face of the elongate hollow housing is defined by a transversely domed or convex segment.

Preferably, in all the aforementioned aspects of the invention, the interior of the housing is provided with support means for one or more webs or strips extending longitudinally of the housing. One such web or strip may be a support web for the light sources and for the electrical connections to these light sources, and may thereby incorporate ribbon cable. A suitable support web is printed circuit board (PCB) laminate. The web or strip may be transversely oriented at any angle, eg. parallel to or normal to the backing surface, or otherwise. The light sources may be on either face or side of the support web or strip, or on both faces or sides.

Connector means is preferably provided to physically couple a pair of the elongate housings whereby the housings may be relatively longitudinally displaced in situ, eg. by thermal expansion or building subsidence, without being uncoupled. Where the light sources are provided on a plurality of support webs or strips having electrically conductive surface elements and extending longitudinally of the housings, connectors are preferably also provided for pairwise electrically and physically coupling the support webs or strips whereby the webs or strips may also be relatively longitudinally displaced in situ without being uncoupled, either physically or electrically. It is particularly advantageous to provide for such displacement both between housings and between support webs or strips carried by an array of the housings.

A further said strip or web may be an optical refractor or diffuser, arranged in front of or behind the light sources as appropriate.

In all aspects of the invention the housing may be hollow and/or may define a passageway in which the light sources are disposed. Alternatively, the housing may be substantially a solid, eg. moulding bout the pre-positioned light sources, or with cavities to receive the light sources.

Where the elongate housing is hollow, it is preferably a plastics (e.g. Polycarbonate) extrusion of substantially uniform cross-section, and is preferably translucent but not transparent. A translucent and also transparent housing may be preferred in some embodiments. The housing can be substantially rigid. A suitable form of the flexible tubular segment is a collapsible pleated web or concertina structure.

Presently, the base strip, flexible tube segments and coupling means are also at least partly provided in translucent material.

The means to diffuse, disperse or scatter may include e.g., a body portion of the housing, and/or light diffuser means in the passageway.

The invention, in a further aspect, provides a connector for physically coupling a pair of generally tubular components, including:

an integral moulded body which defines a pair of generally tubular portions slidably engageable with the respective said tubular components so that their interiors are in communication within the connector;

wherein said integral moulded body further defines a relatively thin wall portion between said generally tubular portions, said thin wall portion being resiliently deformable to compensate for relative variations in the relative positions of the generally tubular portions.

The material of the body is preferably silicone rubber or similar.

In a still further aspect of the invention, there is provided a connector for electrically and physically coupling a pair or more of support strips having electrically conductive surface elements including:

an integral moulded body with features which define spaced generally parallel channels or passages open at their outer ends to receive respective end fingers of the respective said strips, whereby the strips are aligned and generally co-planar;

electrically conductive contact mans in said channel or passages for engaging complementary contacts on said strips when said fingers are received in the channels or fingers;

means carried by said body electrically connecting each of the contact means for one strip carried by said body with one or more of the contact means for the other strip; and resiliently deformable means on said body for latching said body to each of said strips.

Preferably, each of the electrically connecting means is provided contacts as an integral electrically conductive strip—more preferably, the strip is of appropriately conductive material, eg. phosphor-bronze or other alloy, mounted to be resiliently deflect by said fingers.

Preferably, the spaced channels are arranged along opposite sides of the integral moulded body, and open laterally from the body. In an embodiment, these channels are provided in elongate side portions linked by a central crosspiece in an I or H configuration.

The resiliently deformable latch means is preferably provided as a pair of deflectable tongue portions with lugs, which tongue portions is defined by slits in a web portion of the integral moulded body, e.g. bridging said elongate side portions of the body.

In still further aspects, the invention respectively provides (i) a strip lighting system including multiple strip lighting devices as described above, and (ii) a set of components for such a system including multiple such strip lighting devices, flexible tube segments, and suitable coupling means such as, eg., connectors according to the sixth and/or seventh aspects of the invention.

BRIEF DESCRIPTION OF THE DRAWINGS

The invention will now be further described, by way of example only, with reference to the accompanying drawings, in which.

PREFERRED EMBODIMENTS

Figure 1:
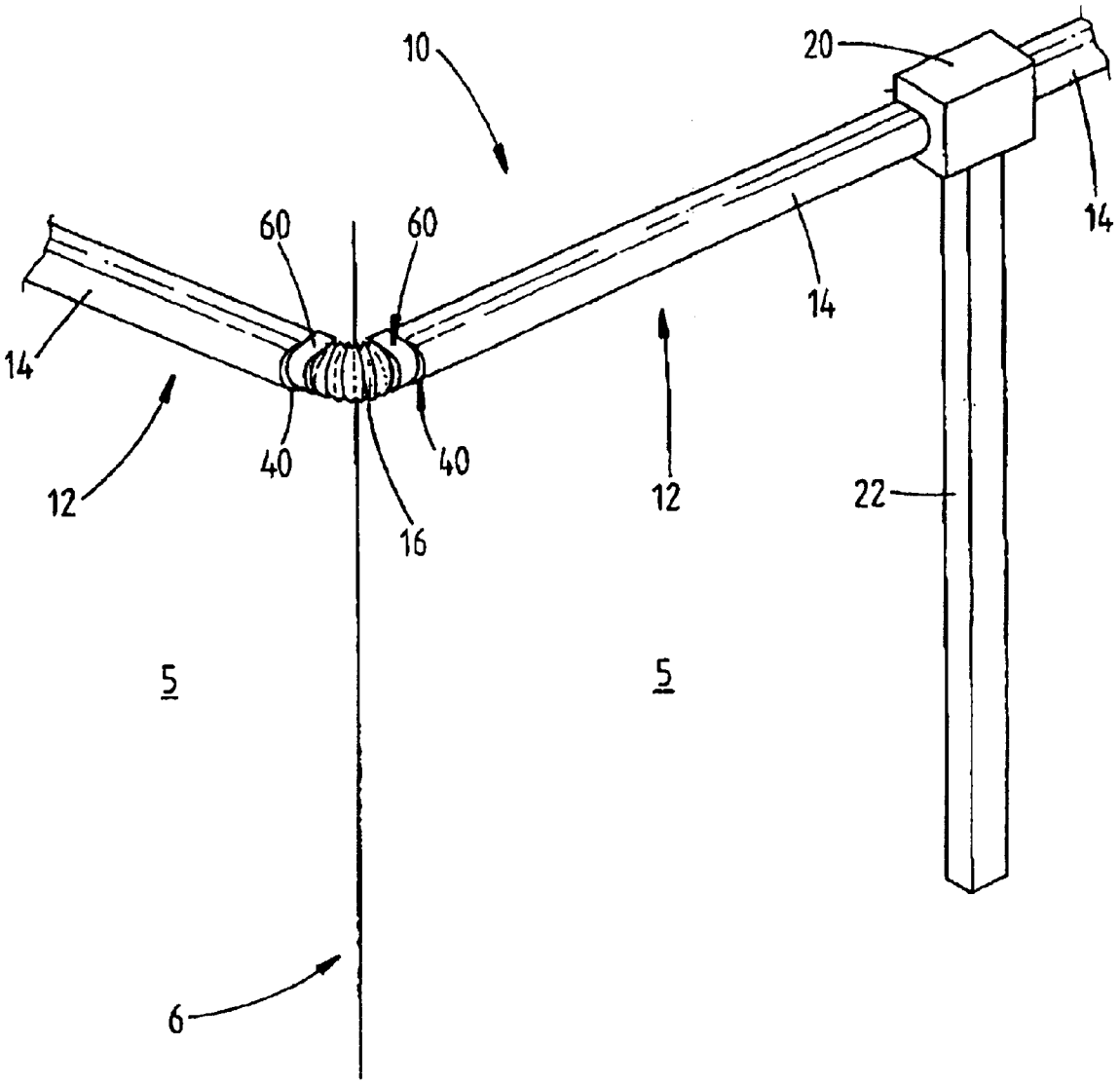
FIG. 1 is a perspective view of a simple arrangement of a strip lighting systems incorporating multiple light source enclosures according to an embodiment of the invention, depicted on the wall of a restaurant or other premises.
Figure 2:
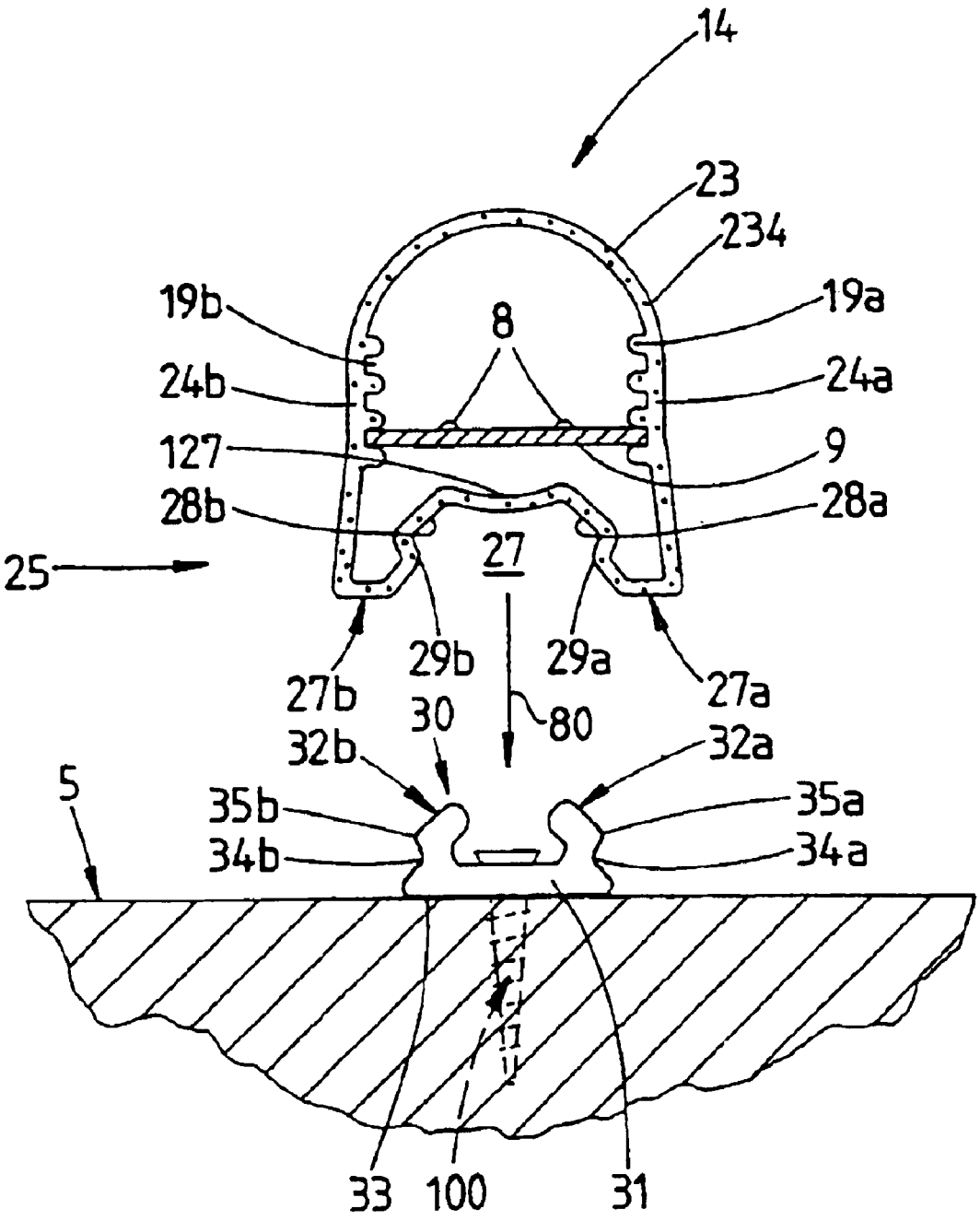
FIG. 2 is an end element depicting a light tube segment and mounting rail ivy for engagement.

Referring firstly to FIGS. 1 and 2, the illustrated strip lighting system 10 includes several light source enclosures 12 each having an elongate hollow housing 14 of a translucent material. Housings 14 am hereinafter referred to as light tube segments. These segments 14 are straight and substantially rigid, and an linked by flexible segments 16, light tube segments 14 define respective internal passageways 13 in which multiple light sources in the form of light emitting diodes (LED) 8 are arranged at intervals on ribbon cable support strips 9, eg printed circuit board (PCB) laminates. These laminates may be of either substantially rigid or flexible type. The LEDs are preferably of the surface mounted type. The electrical conductor cables printed on these strips are electrically connected to an external power source controller via junction boxes 20 and upright cable enclosures 22. The PCB laminate or other support strip way include local or extended layering or coating to provide an optical effect, eg. reflection, in cooperation with the LEDs.

Light tube segments 14 are fixed to respective surface 5 of a structure 6 so that they each extend along and adjacent the surface, by base strips in the form of mounting rails 30 onto which the tube segments 14 can be releasably snap fitted. The mounting rails 30 are in turn fixed onto the surfaces 5 by screws or the like hidden by the attached tube segments.

Other components of the illustrated strip lighting system include end inserts 40 for providing tube segments 14 with end coupling formations, end plugs 50 (FIGS. 19 to 21) for terminating the light tube segments other than at junction boxes, and locking means 60 for disengagably coupling inserts 40 to the flexible tube segments 16 or to the end plugs 50.

Each substantially rigid light tube segment 14 comprises an extrusion of uniform cross-section in a plastics material selected so that it is translucent in a tanner whereby to diffuse, disperse or scatter the light emitted by the interior LEDs, so that the tube appears to glow when viewed from the outside. In this way, an extended strip or line of light is provided, ie. the tube appears to glow over a substantially continuous zone extending over its length and encompassing the contained light sources. The translucent material is preferably such that the LEDs are not visible to the eye when not activated and viewed from outside the housing, and are substantially not distinguishable when activated and viewed from outside the housing.

A suitable material is a polycarbonate polymer composition with appropriate color pigment and a titanium dioxide whitening agent to determine the optical dispersion and degree of translucence or opaqueness. The colour may be chosen to match a colour of the LEDs, or may be any other colour, or white or colourless. The colour is preferably UV stabilised. In an alternative embodiment, the material of the extrusion may contain optional dispersed light scattering elements 234 such as metal shavings or chips, or dust, that are effective to diffuse, disperse or scatter the emitted light and so cause a sparkling effect. In still a further variation of the tube segment, diffusion, dispersal or scattering of the LED light may be facilitated by the presence of fine grooves, ribs, or other surface variations in the extruded segment. The extrusion material may include a component which is optically activated by electromagnetic radiation such as the sun's light or other radiation so that the emitted colour, pattern or other optical characteristic may be altered.

A cross-section of the extrusion is illustrated in FIG. 2. It includes a semi-circular or semi-annular outside portion 23, generally straight side wall portions 24*a*,24*b*, and a slightly flared thin-wall base structure 25 in which a pair of hollow longitudinally extending ribs 27*a* define a central grove or chapel 27. Channel 27 has shallow undercuts 28*a*,28*b* along each side defined behind rounded ridge portions 29*a*,29*b*.

The interiors of side wall portions 24*a*,24*b* of light tube segment 14 are provided with a number, typically four as illustrated, of longitudinally extending ribs 19*a* that are evenly spaced to define intervening grooves 19*b*. These grooves are provided for mounting ribbon cable snips 9, or optical diffuser or reflector strips or other accessories. This will be discussed further below.

Each mounting rail 30 is also an elongate extrusion of uniform cross-section formed in a material similar to light tube segments 14. It has a main base web 31 with two integral outstanding ribs 32*a*,32*b* of shallow V configuration in cross-section. The lateral outside profile of this strip is thereby a close match with the side profiles of channel 27, including a V-groove 34*a*, 34*b* matching ridge portions 29*a*,29*b* and a rib formation 35*a*,35*b* matching undercuts 28*a*,28*b*.

The mounting rail 30 is dimensioned to be an interference fit in channel 27. The hollow thin-wall form of tube segment base structure 25 and the arrangement of ribs 32*a*, 32*b* on mounting rail 30 allow both components to flex and deform so that the tube segments 14 can be demountably attached to the mounting rails by pressing the tube segments onto the mounting rails in the direction of the arrow 80 in FIG. 2. The ribs 32*a*, 32*b* flex inwardly towards each other and the hollow flanges 26*a*, 26*b* of the tube flex apart to allow the rib formations 35*a*, 35*b*to snap past ridges 29*a*, 29*b* into undercuts 28*a*, 28*b*. In this way, the light tube segment can be mounted to a surface such as a wall surface by first fixing the mounting rails in place against the wall with fasteners 81 driven through the main web 31 of the rail, and then snapping the tube segment into place. Mounting rails 30 have a smooth flat rear face 33 for engaging the wall or outer surface on which the rail is mounted, and the fasteners are hidden from view in the assembled configuration. The mounting rails may include provision to support electrical conductors in particular applications. If it is desired at any time to rearrange or dismantle the strip lighting, tube segment 14 can be grasped and pulled off the mounting rails by inverting the snap action. To facilitate the snap-fit, there may be a longitudinal slit in the center of channel 27, at the position indicated in FIG. 2 at 127.

Figure 3:
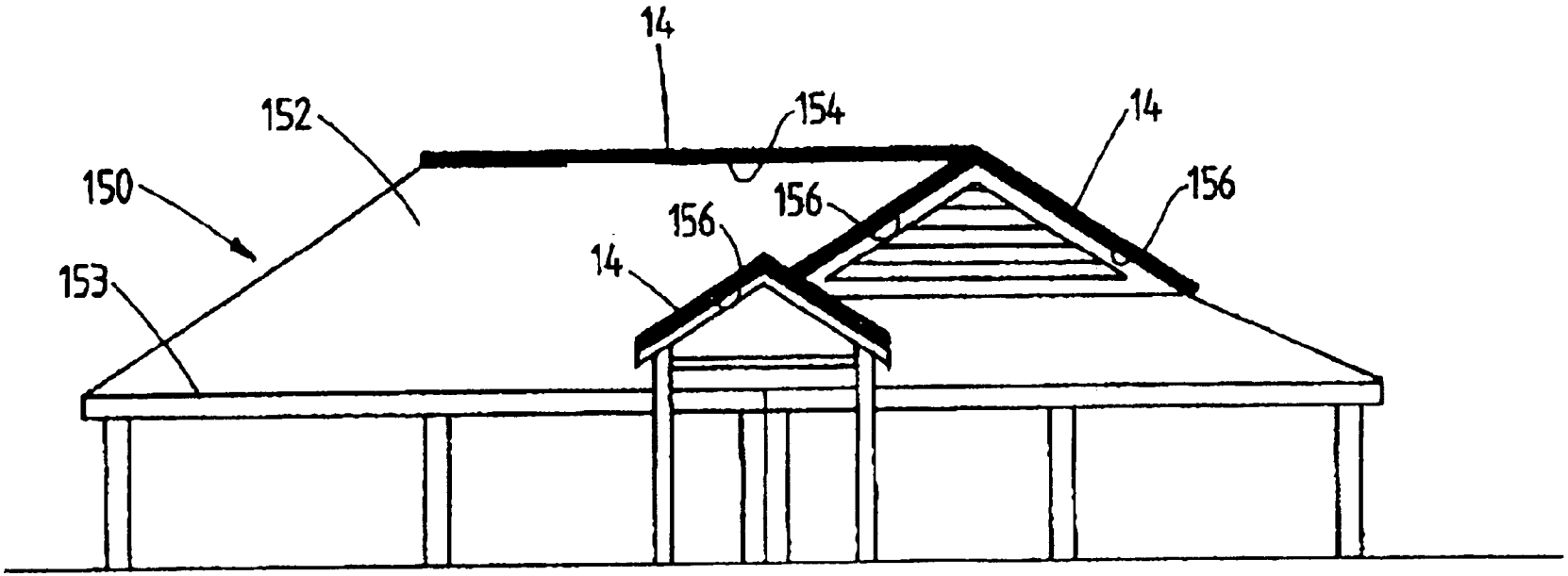
FIG. 3 illustrates an advantageous application of the strip lighting system to the illumination of the roof lines of a building, according to an embodiment of the first aspect of the invention.

It will be appreciated that the illustrated system is adaptable to provide configurations of strip lighting which match or complement a structure or provide a particular shape, eg. a recognisable shape. An advantageous application is illustrated in FIG. 3. A building 150, eg. a commercial press such as a restaurant, includes a roof 152 with peripheral edges 153 and corners such as ridge line 154 or gables 156. Certain of these edges and corners are fitted with light tube segments 14 to form, a strip lighting system for the roof. The strip lighting system thus highlights and decorates the respective features of the roof. The colour of the tube segments may be chosen to complement the colour scheme of the building and/or to match the colour(s) of identification or trade mark signage displayed on the building. It will of course be understood that the strip lighting system may be applied with similar effect to other building lines, both internal and external.

With good choice of LED characteristics, colour and spacing, the effect of the strip lighting system on the building as illustrated in FIG. 3 is to enhance the profile of the roof line without creating glare, and without being unduly ostentatious. The light has a richness without excessive brightness. Undesirable dark spots are eliminated or reduced. Major electrical switchboard adjustments are avoided, and the inventive system does not include the inconvenience, high maintenance and fragility of neon tubes. Fixings are concealed and easy to install, and protruding structure, which might attract birds, is avoided. Very long continuous lines of light can be achieved, whereas neon tubes require regular interruption by discharge boxes.

Figure 4:
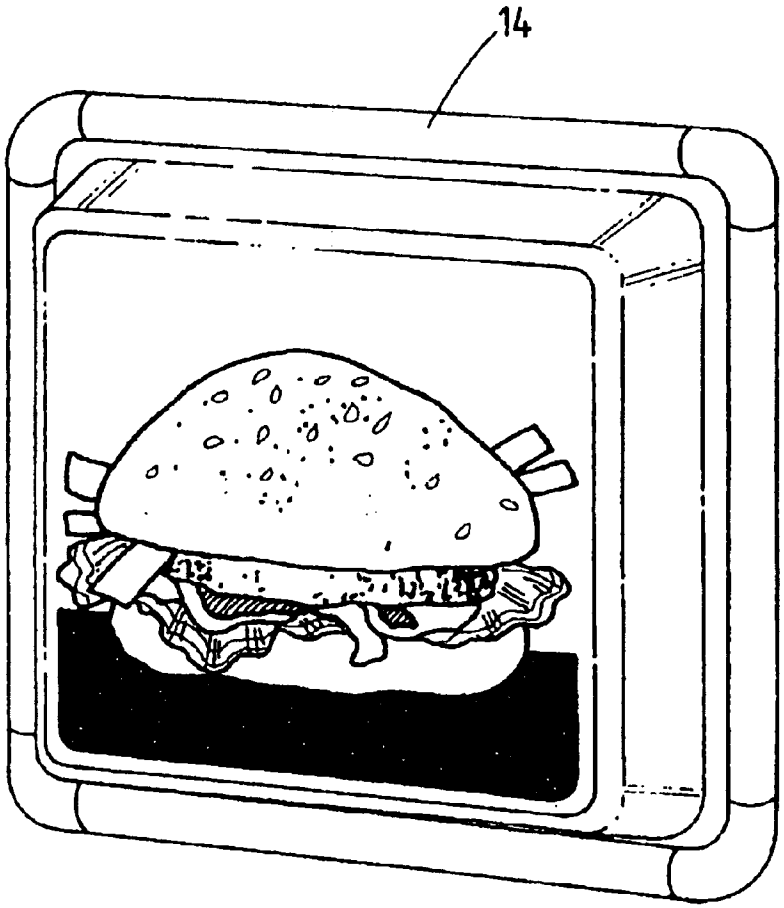
FIG. 4 illustrates an application of the invention to the framing of a display signage unit.
Figure 5:
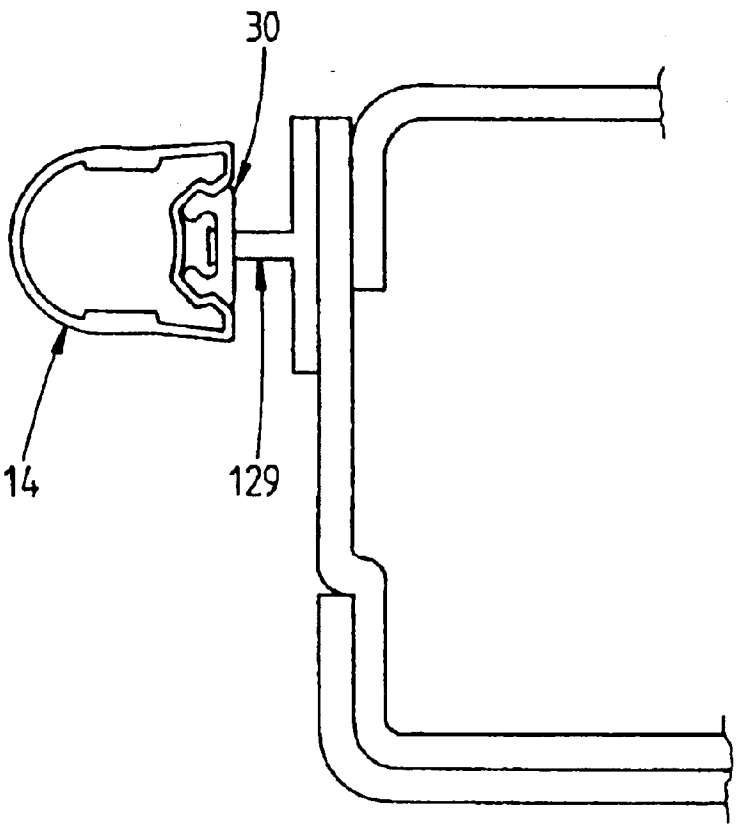
FIG. 5 is a fragmentary cross-section of part of the unit of FIG. 4.

In a variation, mounting rails 30 may have an integral leg or rib, eg. T, L, or X section, for elevating the rail from an edge or surface. Twin rail extrusions may be provided. These variations may assist in eg. positioning tube segments 14 as framing for surface mounted features. FIG. 4 illustrates the application of the strip lighting to a promotional display sign, and FIG. 5 is a sectional view showing the T-section leg 129 of mounting rail 30. This highlights the application of the invention to shopfitting generally. Other applications include playgrounds eg. to highlight posts or rails, and children's locations in general. In alternative applications, the mounting rail may be free-standing.

Figure 6:
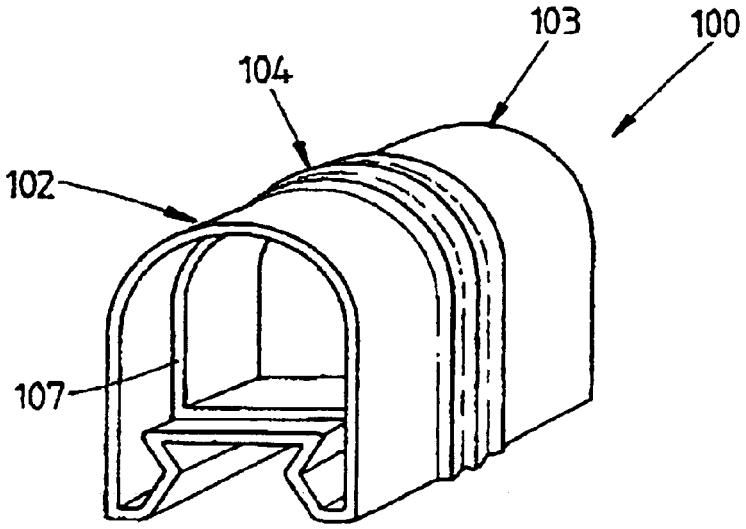
FIG. 6 is a perspective view of a form of connector for coupling two light tube segments.
Figure 7:
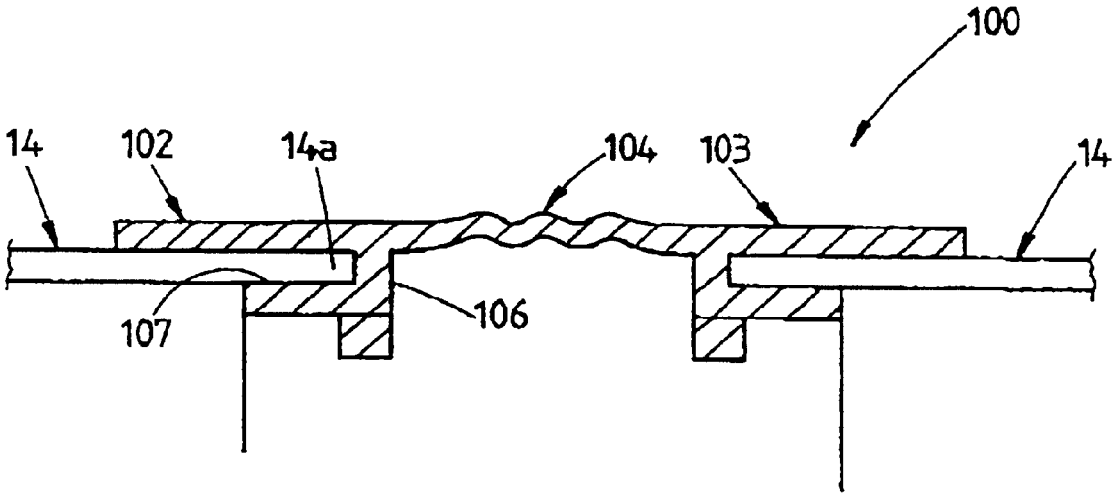
FIG. 7 is a fragmentary cross-sectional view of the connector of FIG. 6 in situ.

FIGS. 6 and 7 depict an embodiment 100 of connector for coupling a pair of tube segments 14 to form a longer strip of Light for applications such as that depicted in FIG. 3. This connector is simple in form yet effective in adjusting for relative a movement between the tube segments, eg. due to thermal expansion or contractions. Connector 100 is an integral generally tubular moulding in liquid silicone rubber which consists of a pair of substantially identical socket portions 102, 103 linked by a relatively thin walled centre portion 104. Each socket portion 102, 103 has an internal profile to closely match the external profile of tube segments 14 so that each is slidably engageable with and about an end of a respective tube segment 14 so that the interiors of the tube segments are in communication within connector 100.

At their inner ends, each socket portion 102, 103 has an internal flange 106 that defines a peripheral groove 107 to receive and sealingly grip the end 14*a* of the tube segment. Centre portion 104, bridging the two flanges 106, is sufficiently thin to be able to accommodate or compensate for relative movement of the tube segments without uncoupling of the tube segments, by resiliently bucking, stretching or otherwise deforming. Further compensation is provided by sliding movement of the tube segments longitudinally of groove 107. The material of the connector should be chosen to facilitate and optimise this role. Liquid silicone rubber (SP,) is especially suitable, because of its excellent elastic memory in deformation, its ability to sealingly grasp the tube segments, and its overall durability. The moulding thus achieves a substantially waterproof coupling with structural integrity, able to compensate for thermal expansion and other displacement between the tube segments 14.

Figure 8:
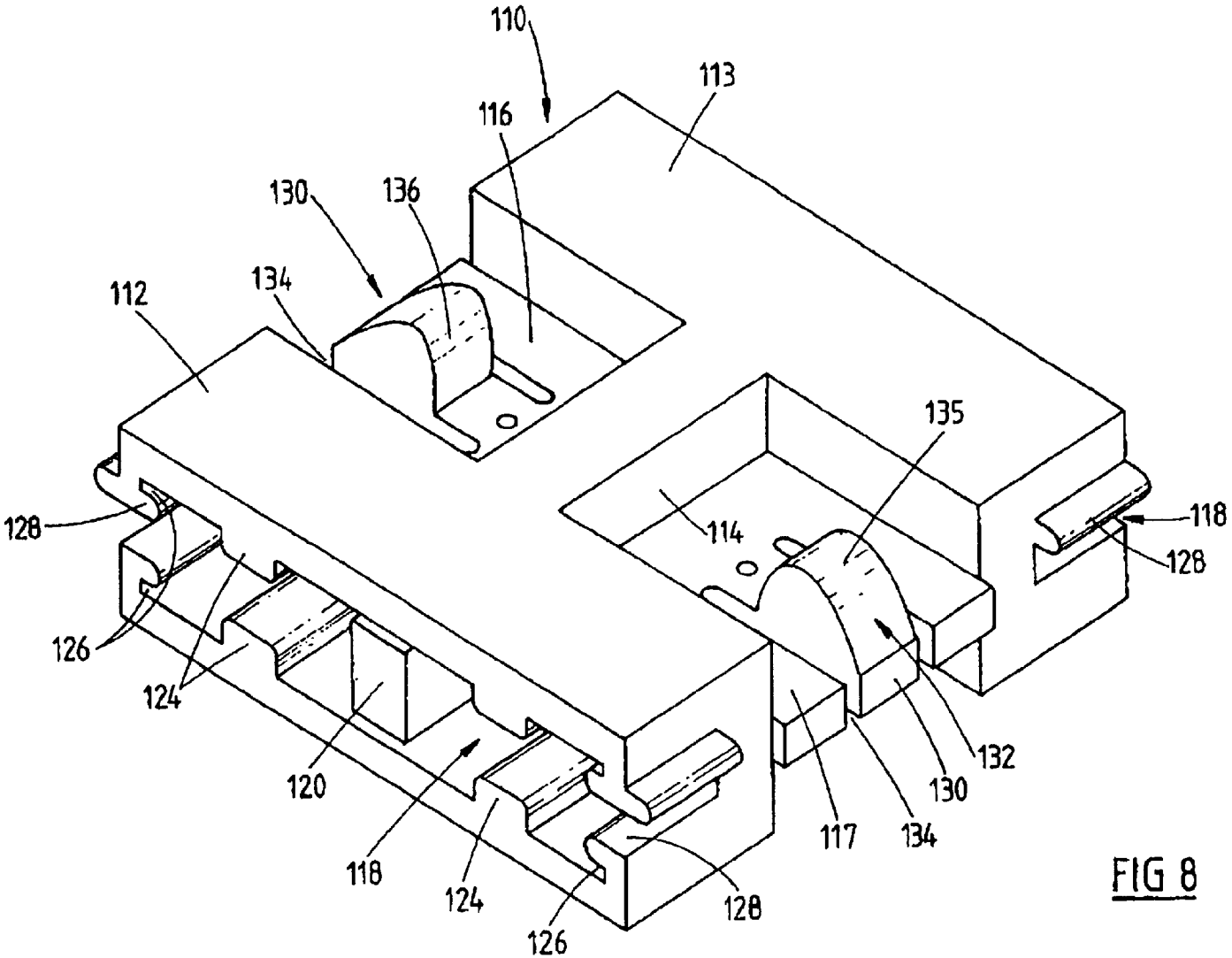
FIG. 8 is an isometric view of a connector for coupling the cable ribbon support strips, being an embodiment of the sixth aspect of the invention.
Figure 9:
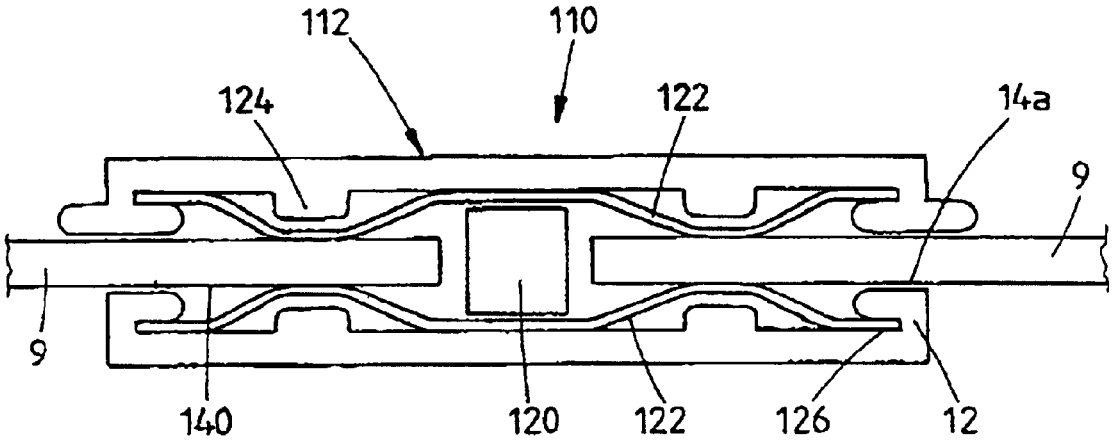
FIG. 9 is a side elevational sketch of the connector shown in FIG. 8, with support strips inked into position.

FIGS. 8 and 9 illustrate an embodiment 110 of connector for electrically and physically interlinking ribbon cable support strips (typically PCB laminates) 9 within tube segments 14, or within a coupling between them.

Figure 10:
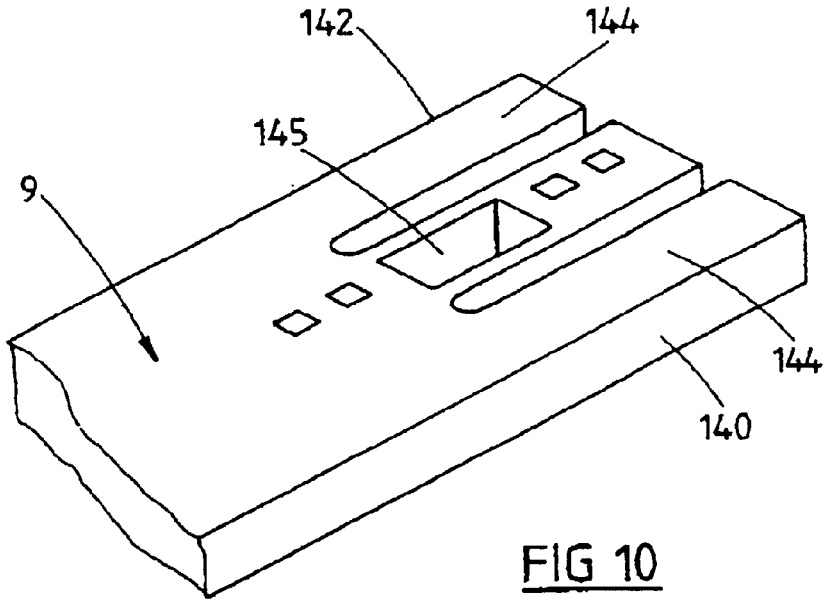
FIG. 10 shows an end portion of a support strip slit to co-operate with the connector of FIG. 8.
Figure 12:
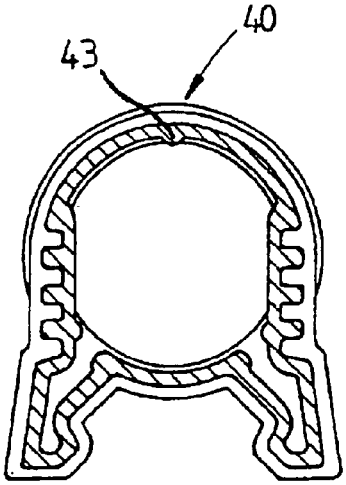
FIG. 12 is a cross-section on the line 12—12 in FIG. 11.
Figure 11:
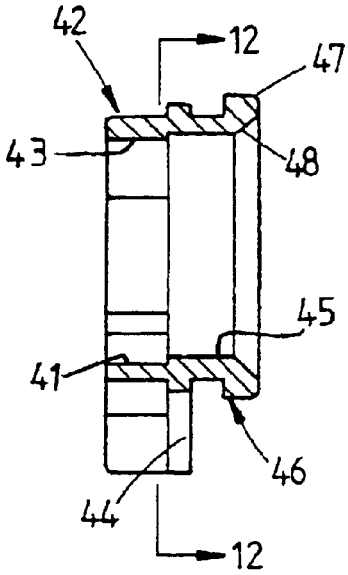
FIG. 11 is an axial cross-section of an end-insert.
Figure 13:
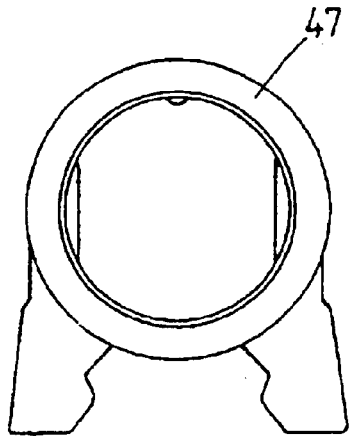
FIG. 13 is an outer end-elevation of the end-insert.

Again connector 110 is an integral moulding in a suitable material. The moulding defines a solid body comprising spaced parallel elongate side portions 112, 113 linked by a central cross-piece 114 in an I or H configuration. The bights within this body are closed by generally rectangular web portions 116, 117. Along the outside of side portions 112, 113 are respective channels 118, open laterally of the connector. Each channel is divided by a centre block lug 120. Mounted against top and bottom of each channel is a respective spring metal strip 122 (eg. of phosphor bronze, not shown in FIG. 8) shaped to pass over lug 120 and under intermediate lugs 124, and retained by slots 126 in end ribs 128. The ends of channels 118 are open, between ribs 128, to receive respective end fingers 140, 142 of PCB laminates 9 (FIG. 10). These fingers force contact strips 122 resiliently apart, so ensuring electrical contact with contacts 144 on the top and bottom faces of the strip fingers.

The PCB laminates 9 are latched to the connector by engagement of lugs 132 in matching apertures 145 (FIG. 10) in the laminates. Lugs 132 are provided on resiliently deflectable tongues 130 defied in the open edges of web portions 116, 117 by slots 134. Lugs 132 have an inclined outer strike face 135 by which the strip forces the tongue/lug pair aside, and a steep inner face 136 which provides the latching function. Tongues 130 can be deflected manually to uncouple the components.

Connector 110 would typically include a formation (not shown) to prevent coupling except in a correct relative strip orientation. Connector 110 is also preferably such as to allow relative longitudinal displacement of the respective laminates, eg. between limits determined by co-operating abutments without their being uncoupled either physically or electrically. Connector 110 is preferably designed and coloured to minimise disruption to the uniformity of the light pattern emitted by the connected tube segments.

A set of the various components described and illustrated herein may be delivered to a site and mounted to a structure or set of walls in the manner described. Connectors 110 would be used to bridge the diode mounting strips via the interiors of the flexible tube segments 16, and electrical power would be delivered to the diodes via upright cable enclosures 22 and junction boxes 20 (FIG. 1) to which at least some of the tube segments 14 would be attached. Advantageously, the light levels of multiple tube segments could be controlled at a central point to achieve balance, or to obtain particular effects. In another alternative arrangement, each tube segment or respective subgroups of tube segments may have a separate brightness control, eg. a current level adjustment device mounted In the tube segment or adjacent mounting rail.

It will be appreciated that the light emitting diodes may be of any suitable type, e.g. the three-colour diode sets now available, but it is desirable to avoid excessive variations in outputs between diodes for a given current, and to seek long life LED products. The LEDs could be simply activated to provide constant and uniform illumination, or could be managed in a variable sequence by programmed logic circuits either internal or external to the illustrated configuration. By similar means, random and variable patterns, colour and hue variations and colour changes can be achieved.

Because the connectors 100 allow a degree of relative longitudinal movement between adjacent coupled tube segments 14, and the connectors 110 perform a similar function between adjacent coupled PCB laminates 9, the system is able to simultaneously compensate for or accommodate such dual movement eg. due to thermal expansion or building subsidence, both externally in the array of tube segments 14 and internally in the contained array of PCB laminates. Provision for such compensation is advantageous in most "real-world" applications of the inventive concepts.

As already noted, light tube segments 14 may be fitted with end inserts 40 to allow them to be connected to other fittings. A typical such insert is illustrated in FIGS. 1 to 13. It is an integral moulding in a suitable plastics material, preferably that used for segments 14 and 42 and mounting rails 30. The insert essentially includes three axially successive portions, i.e. a plug portion 42, and end flange 44 and a connector portion 46. Plug portion 42 is precisely matched to make an interference fit into either of the open ends of a light tube segment 14 and thus has an external profile complementary to the internal profile of tube segments 14. The interior of the insert is provided with a peripheral shallow shoulder 41 at the transition between plug portion 42 and flange portion 44, and with a longitudinally extending convex rib 43 at the top interior of plug portion 42. These features are for locating and keying electrical cable ribbon connectors as and if required.

End flange 44 is a lateral enlargement about the whole of plug portion 42 and has an external profile which closely matches that of each tube segment 14. It may thus also be snapped onto a base strip 30 if needed at an intermediate position on the base strip.

Connector portion 46 is a generally tubular coaxial extension from flange 44 having two additional features at its outer axial end: an external flange 47 and a peripherally extending frustoconical enlargement 48 of the internal bore 45. This enlargement is to provide an O-ring seat, as will be further explained. The flange 47 locates a locking ring 60.

An assembled tube segment 14 for installation would be fitted with at least an array of light emitting diodes 8 mounted on a suitable cable ribbon support strip 9. Typically, this strip would be mounted in a lower pair of grooves 19*b*. If desired for particular effects, a suitable diffuser ship may be mounted in another of the groove pairs, or a refractor strip may be mounted in a still further pair, typically between the light emitting diodes and the diffuser strip relative to the curved front of the tube. Once these are in place, they can be retained by fitting inserts 40 to either or both ends of the tube and fixing them in place with a suitable adhesive or contact cement at the interface between plug portion 42 at the internal surface of the tube. Other fixing and closure arrangements are of course possible.

The orientation of the plane of strip 9 may be varied in other embodiments. For example, this plane may be normal to surface 5 in FIG. 2. Moreover, LEDs 8 may be on either or both surfaces of strip 9.

Figure 14:
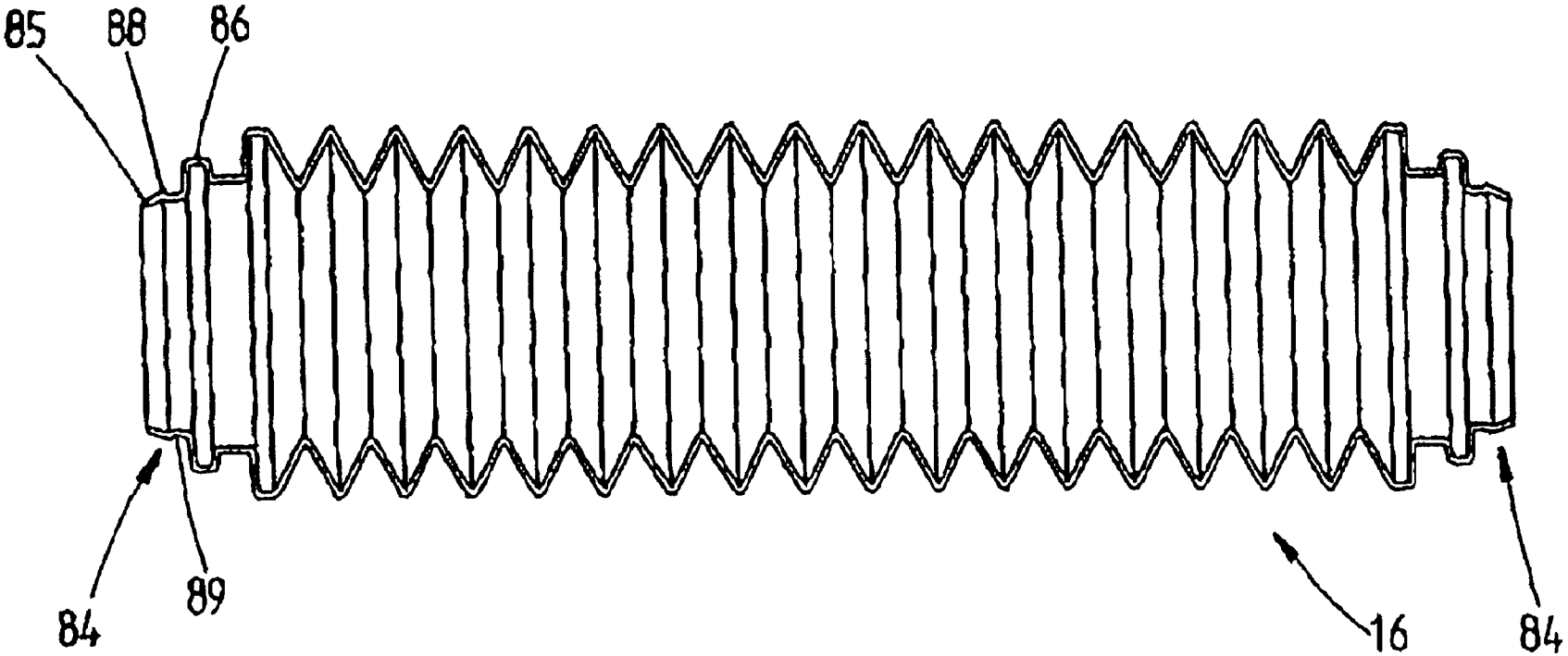
FIG. 14 is an axial cross-section of a flexible tube segment for linking light tube segments where they are not aligned.
Figure 18:
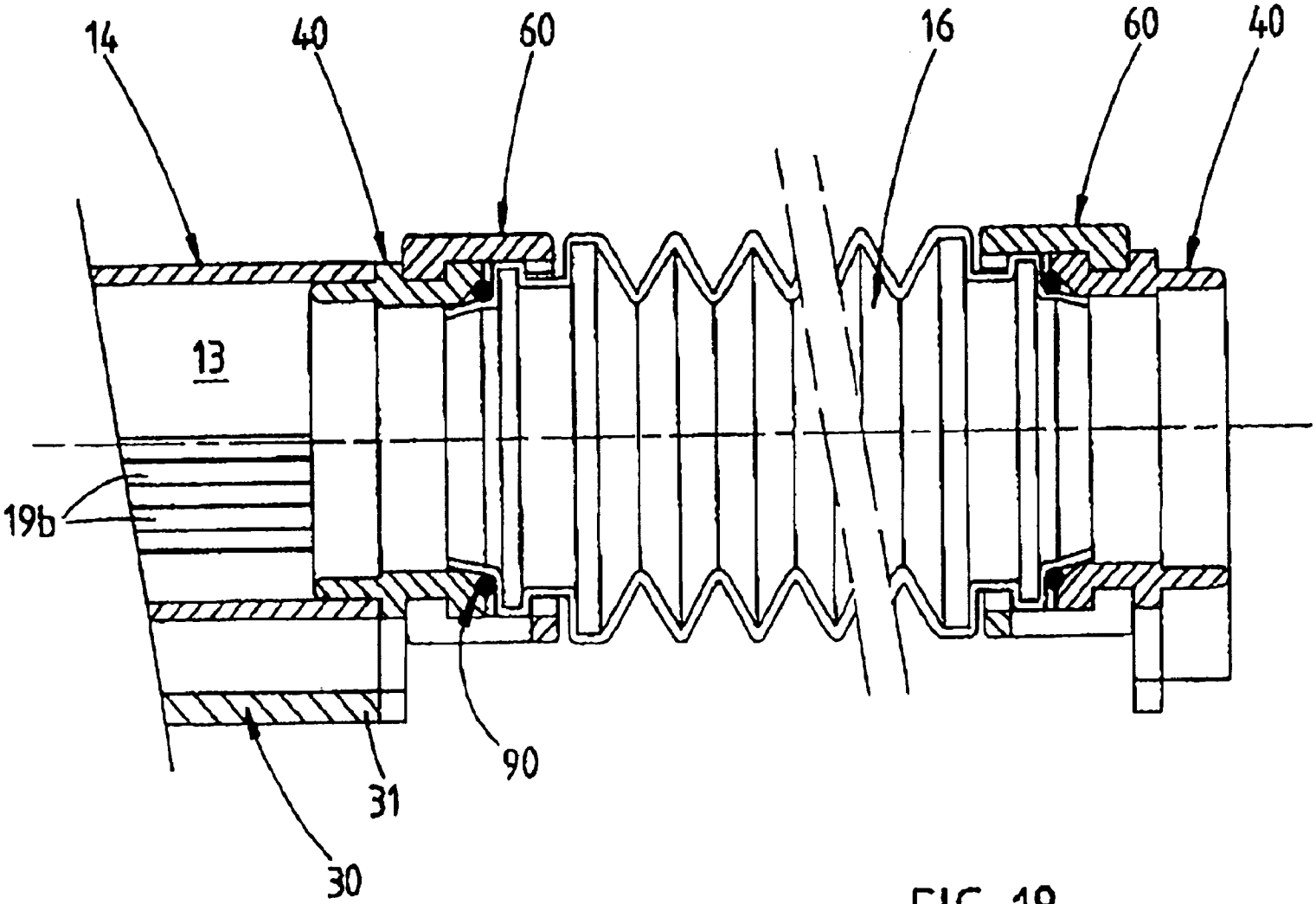
FIG. 18 is a fragmentary cross-section illustrating the assembly of a pair of substantially rigid light tube segments to an intervening flexible light tube segment of the form shown in FIG. 14.

A flexible tube segment 16 is shown in situ in FIG. 1 and detailed in FIGS. 14 and 18. Flexible tub segment 16 is a thin walled moulding of a translucent material similar to that of tube segments 14. The general structure is of a corrugated or pleated configuration by virtue of which the segment is highly flexible and able to be compressed concertina-fashion, bent along its axis through 90° or more. The segment is provided with end portions 84 which include a tapered spigot 85 and a pair of diametrically opposite arcuate lugs 86 which are set back from tapered end portion 85 so that a very shallow reversely-facing annular shoulder 88 at the inner end of spigot portion 85 defines an O-ring seat 89 between it and lugs 86.

Figure 15:
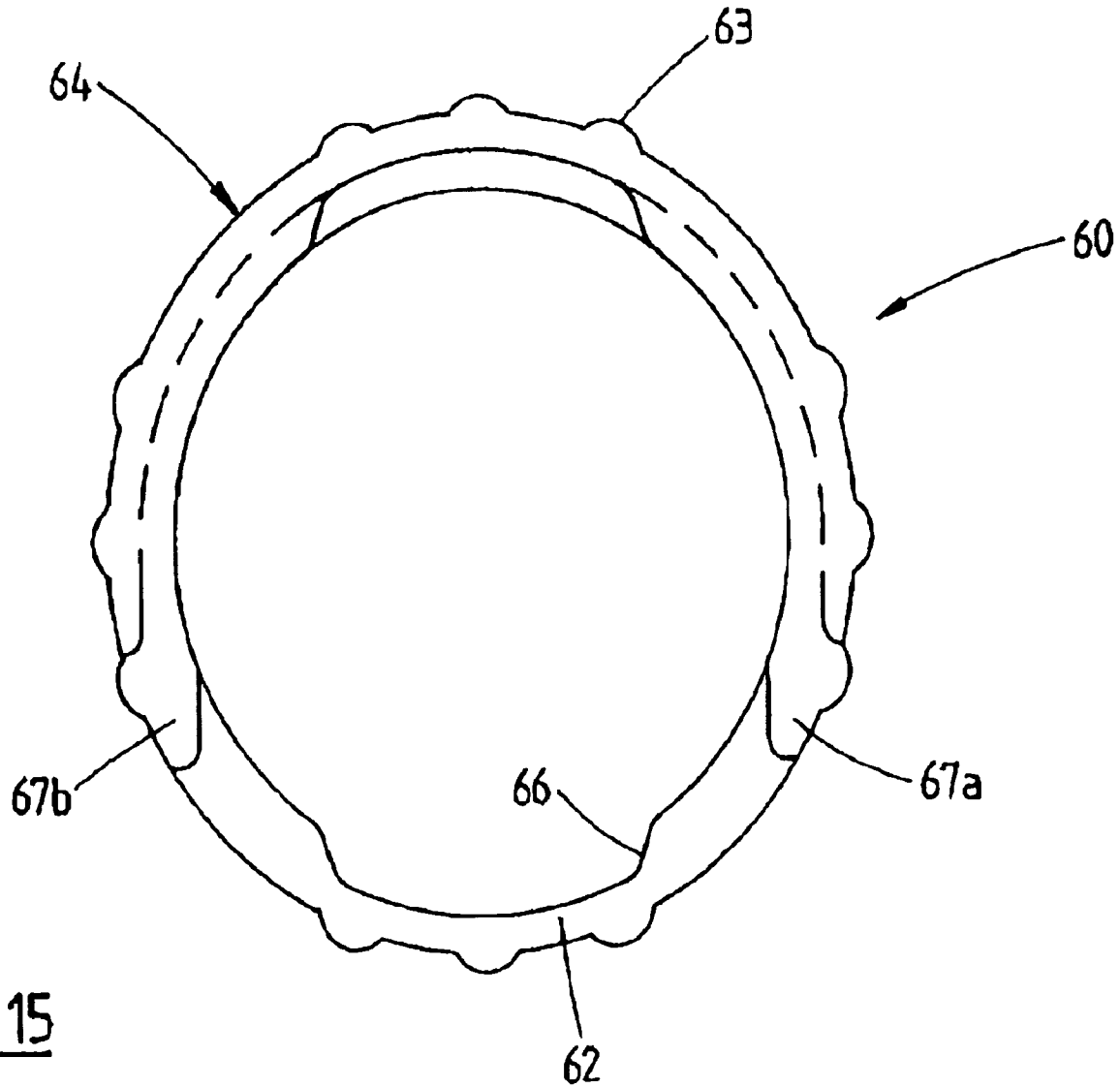
FIGS. 15 and 16 are an end-elevation and an axial cross-section of a locking ring.
Figure 16:
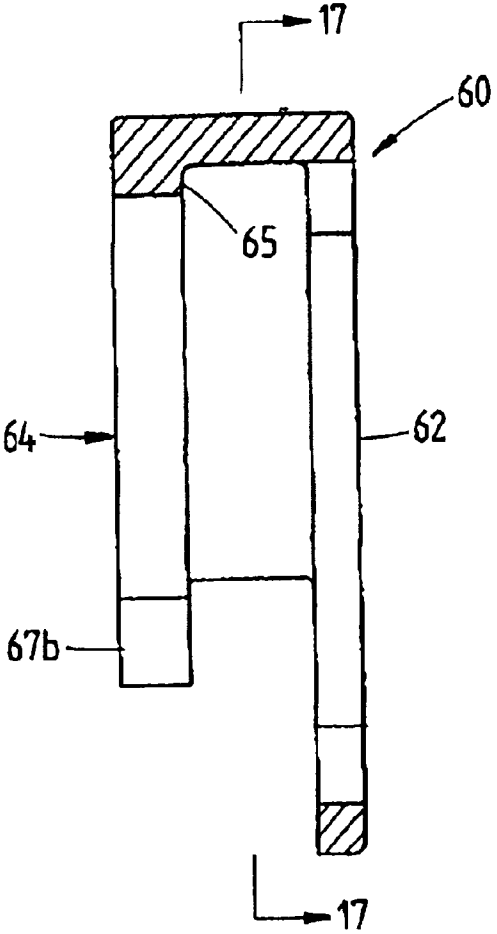
Figure 17:
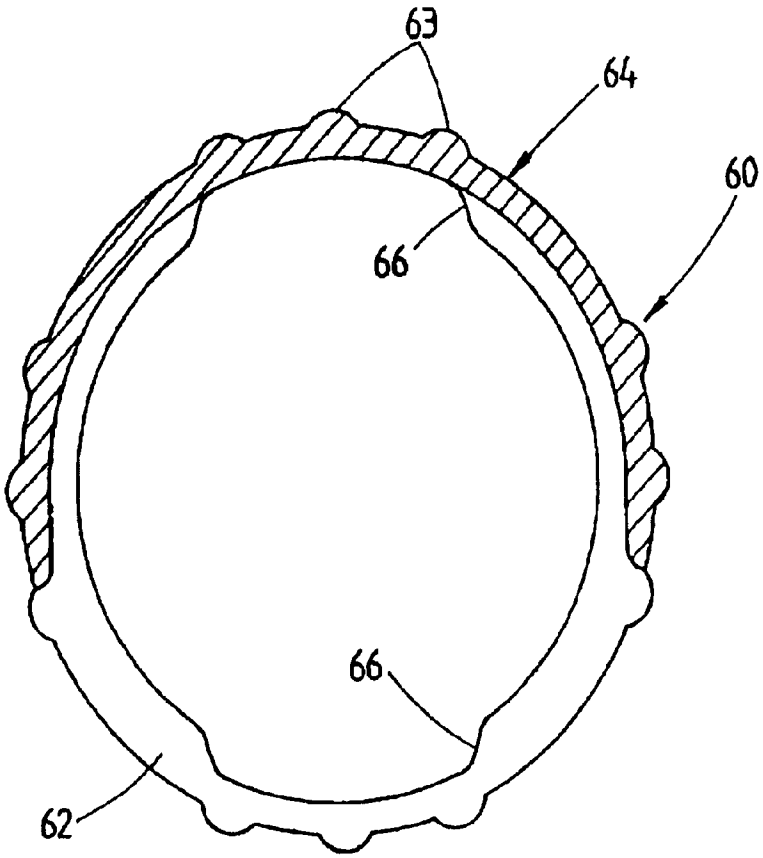
FIG. 17 is a cross-section on the line 17—17 in FIG. 16.

A further component for effecting coupling of the flexible tubular segments 16 to the rigid tube segments 14 is integrally moulded locking ring 60 (FIGS. 15 to 17). This essentially consists of a bayonet socket ring 62 and a snap fit half ring 64 with an undercut 65. The outer surface of the ring has integral grip-enhancement ribs 63. Bayonet socket ring 62 has diametrically opposite arcuate recesses 66 that are matched to receive lugs 86 of flexible tube segments 16. The snap fit half ring 64 is slightly larger than semi-circular, subtending at its outer rim about 250° and extending between deformable wings 67*a*,67*b*.

With reference now to FIG. 18, which depicts in cross-section an assembly of a flexible tube segment 16 with tube segments 14, the locking ring 60 is applied to the body of insert 40 behind flange 47:the wings 67*a*,67*b* deform apart so that the locking ring snaps about the body of the insert and is then retained by engagement of flange 47 behind undercut 65. The end formation 84 of a flexible tube segment 16, with the O-ring 90 in seat 89, is then introduce into the locking ring by passing lugs 86 through recesses 66. On twisting of either component, the O-ring 90 held in seat 89 is clamped, against frustoconical end surface 48, thereby clamping all of the components together to form the assembly shown in FIG. 18. The joint is preferably liquid tight and/or gas tight, especially if the system is intended for outdoor installation.

Figure 19:
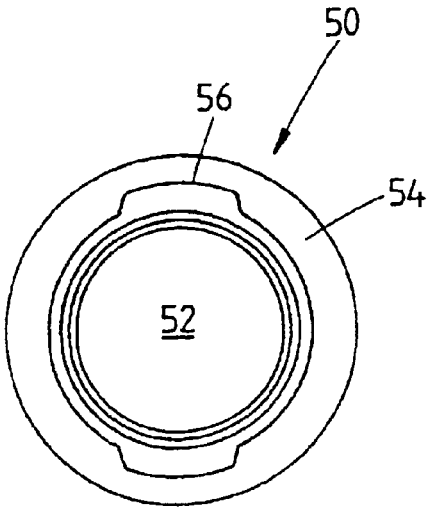
FIGS. 19 and 20 depict two views of an end plug.
Figure 20:
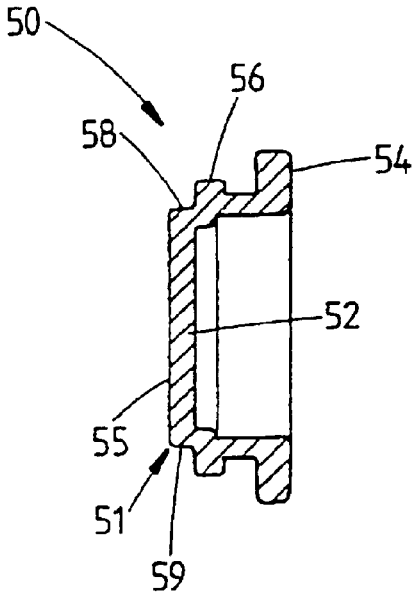
Figure 21:
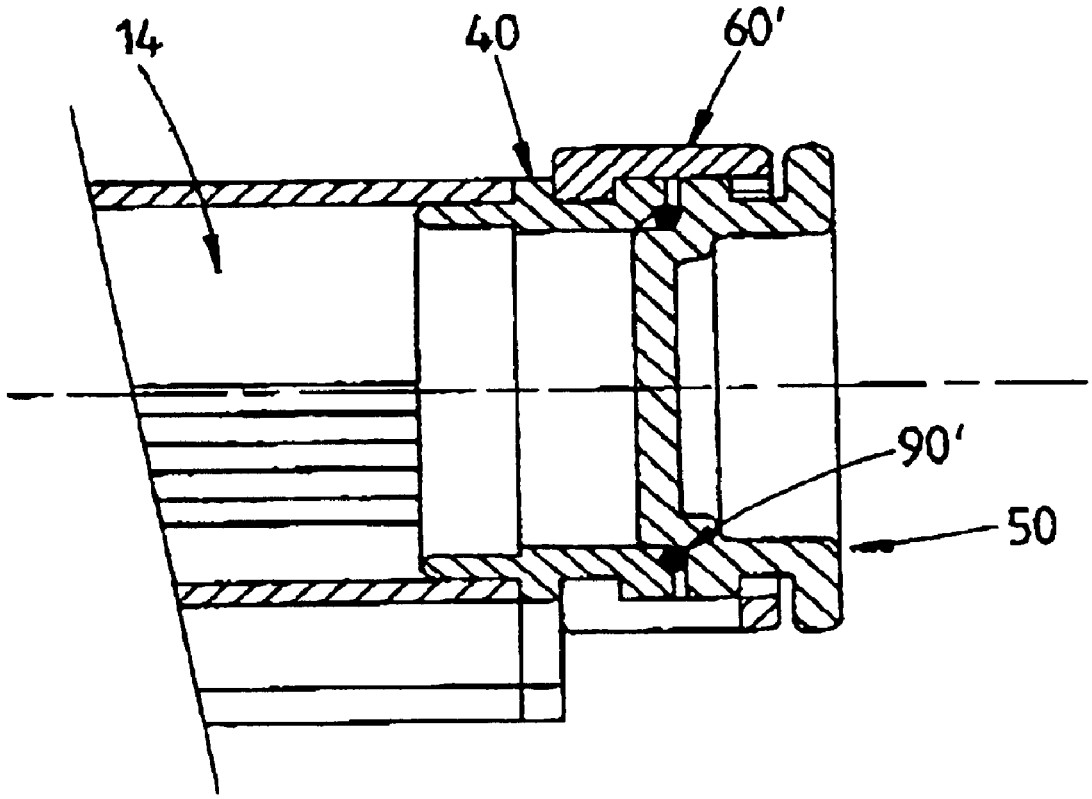
FIG. 21 is a cross-sectional view showing termination of a light tube segment by an end plug.

Instead of coupling a tube segment 14 to another tube segment 16, the former may be terminated by means of end plug 50 (FIG. 19 to 21). End plug 50 has an end formation 51 similar to end portion 84 of flexible tube segment 16, including a spigot portion 55, shoulder 58 and O-ring seat 59. However, in this case, the interior is closed by a transverse membrane 52 flush with the spigot end of the plug, and the component is completed by in external flange 54. Assembly to an end insert 40 using a locking ring 60, and clamping an O-ring 90, is similar to that described above for the flexible tube segment and is depicted in FIG. 19.

Figure 22:
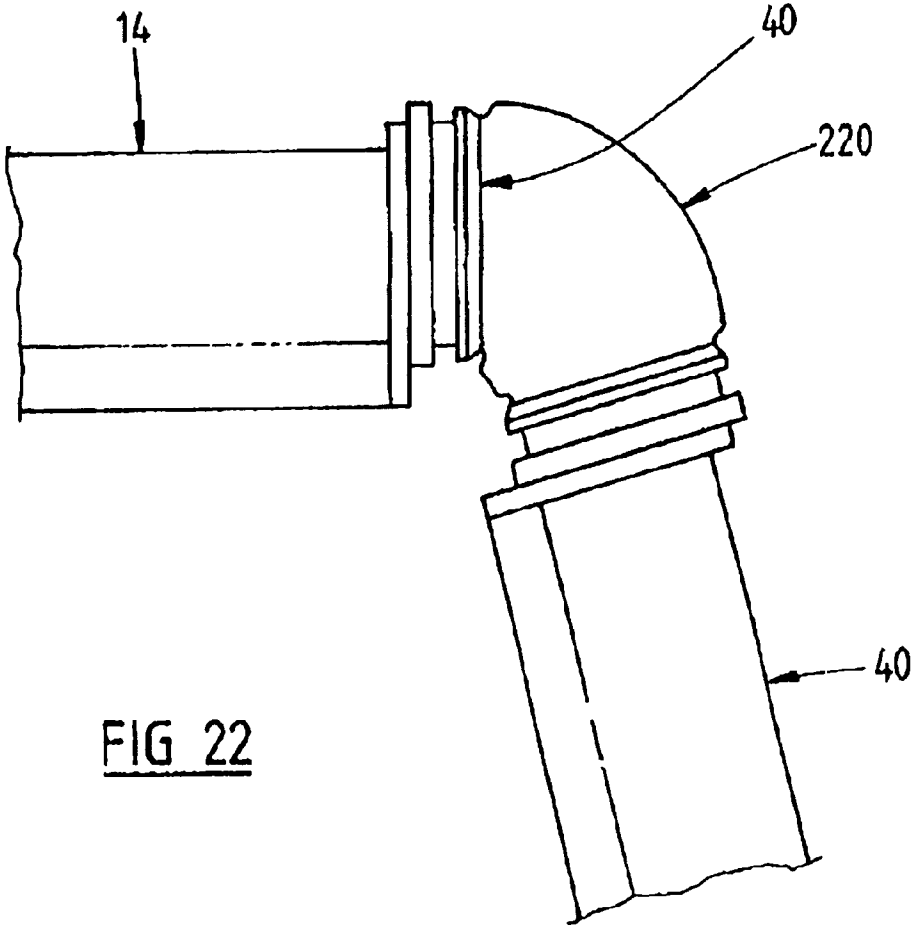
FIG. 22 depicts, in section, an elbow.

End inserts 40 can also be employed to couple a pair of tube segments to the respective ends of a tubular elbow component 220 (FIGS. 4, 22) defining a selected angle bend between the two segments. This component may be rigid or flexible, and may conveniently also be formed in the aforementioned liquid silicone rubber (LSR).

Figure 23:
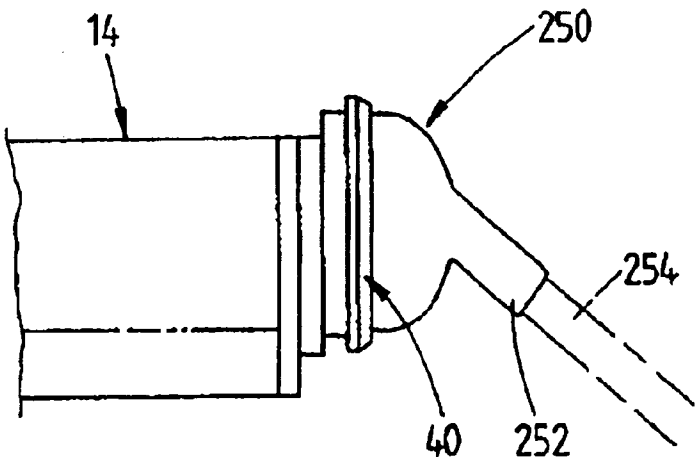
FIG. 23 shows an alternative form of end-cap.

An alternative to end plug 50 is depicted in FIG. 23, and consists of a LSR end cap 250 that fits onto end insert 40 and may include a port 252 for a cable 254 or other accessory. This allows an effective watertight seal around the cable.

Figure 25:
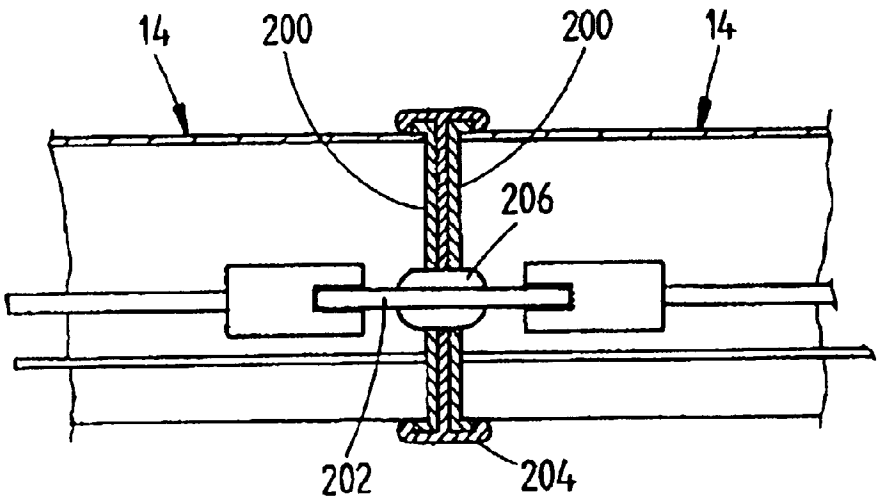
FIGS. 24 and 25 illustrate, in isometric and cross-sectional views, a further alternative arrangement for interconnecting two of the tube segments end to end.
Figure 24:
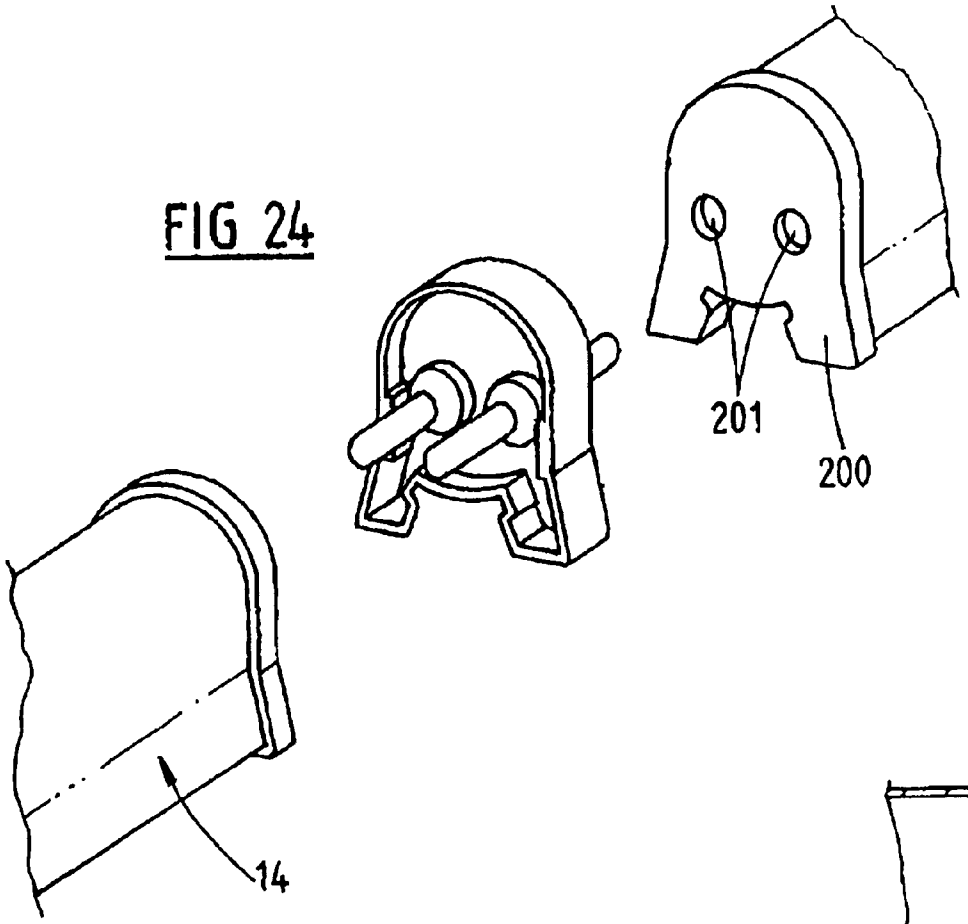

An alternative coupling arrangement is shown in FIGS. 24 and 25. Here, the tube segments 14 are closed by polycarbonate end caps 200 with ports 201 for conductor pins 202. These pins 202 are held in a liquid silicone rubber coupler 204 shaped, like connector 100, to the profile of the tube segments. Coupler 204 has central bosses 206 that retain he conductor pins 202 and project into and seal ports 201. Coupler 204 embraces and grasps the respective end caps 200.

The illustrated embodiments—with the enclosed tubes 14, 16, separate mounting rails 30 and various forms of coupling—provide a strip lighting system in which the LED's arm protected In an environment which is able to be sealed against moisture incursion, but is easily installed and dismantled. The installation may thus be substantially permanent or oily temporary. Tubes may be readily detached individually for service of the electrical componentary, eg replacement of failed diodes.

Figure 26:
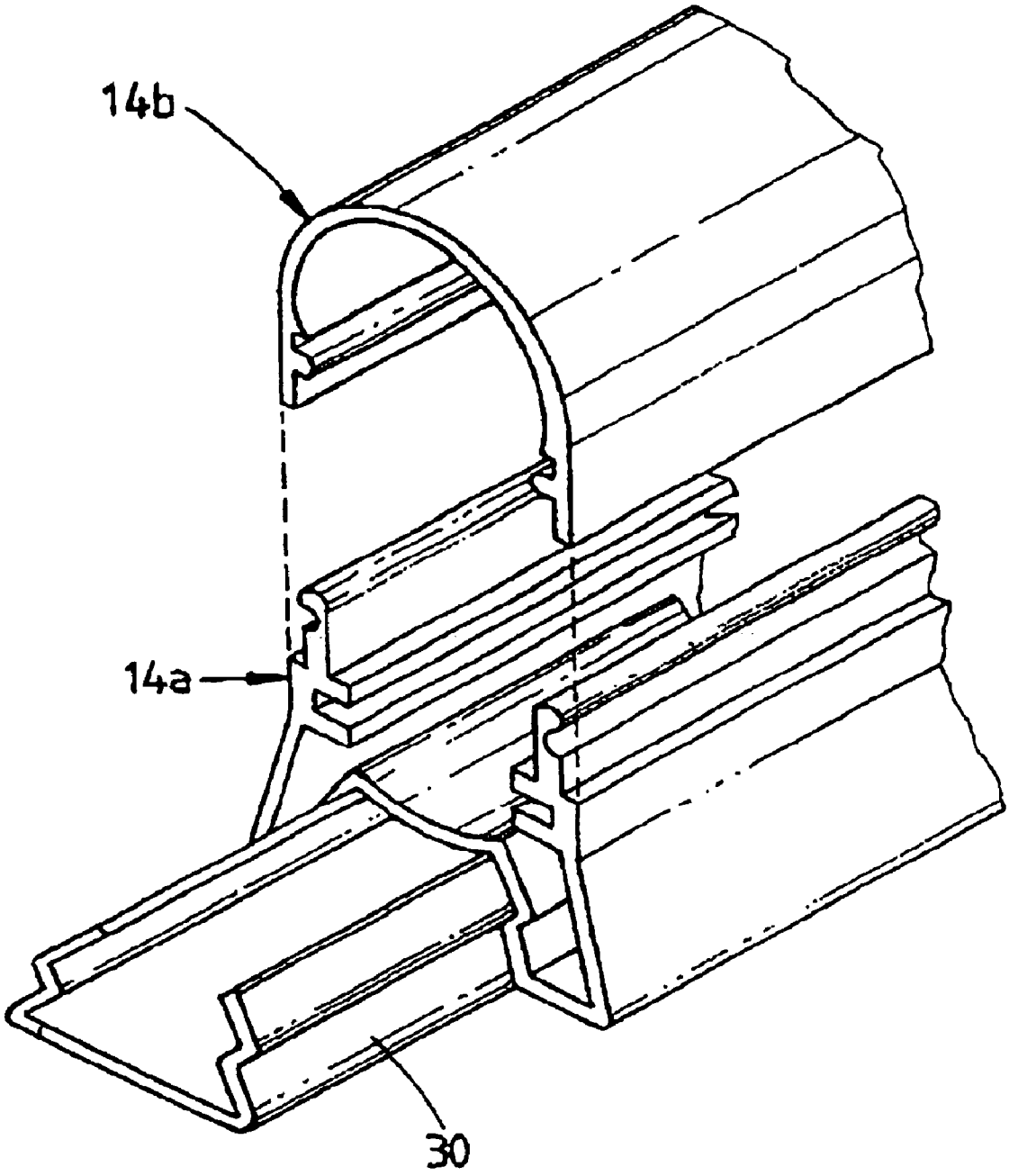
FIG. 26 is a sectioned isometric view of a modified tube and rail assembly.

The component bodies—tube segments 14,16, mounting rails 30, external connectors 110, end inserts 40, locking ring 60, and end plugs 50—may be provided in a single uniform colour, or in any other colour configuration. By forming all of the components in translucent optically diffusive material, advantageous continuity of the strip lighting can be achieved. Variations of intensity are easily obtained with choice of material and into LED configuration or control. In an alternative arrangement, the tube segments 14 and the mounting rails 30 may be extruded in quite different coloured materials. In a still further variation, illustrated in FIG. 26, the tube segments 14 may be separable into base 14*a* and cap 14*b* portions of different colours and/or materials.

What is claimed is:

1. A strip lighting device which includes:

an elongate housing comprising a hollow enclosure with at least one opening, wherein said elongate housing is at least partially translucent and is a single piece of material having one or more cavities to receive said light sources;

a plurality of light sources arranged at intervals within said hollow enclosure; and a fastener, separate from said elongate housing, for fastening said elongate housing to a surface;

wherein said housing overlies the plurality of light sources and diffuses, disperses, or scatters light emitted by the light sources such that individuals of the plurality of light sources are substantially not distinguishable when activated and viewed from outside said housing.

2. A strip lighting device according to claim 1 wherein the housing includes multiple scattering elements.

3. A strip lighting device according to claim 1 wherein said light sources are semiconductor light emitting devices.

4. A strip lighting device according to claim 1 wherein an outer face of the elongate housing is transversely domed or convex.

5. A strip lighting device to claim 1 wherein said housing is a single piece of hollow material comprising a passageway in the hollow portion extending longitudinally of the housing, and wherein said light sources are disposed in said passageway.

6. A strip lighting device according to claim 1 wherein said elongate housing has a substantially uniform cross-section.

7. A strip lighting device according to claim 5 wherein said light sources are semiconductor devices such as light emitting diode (LED) devices and wherein said semiconductor or LED devices are arranged on a printed circuit board strip extending along and mounted within said passageway.

8. A strip lighting device according to claim 1 wherein said fastener comprises a mounting rail adapted to be fastened to said surface, and cooperable means on the rail and on said housing for effecting a snap or sliding engagement of the housing to the rail so that the housing is generally parallel to the rail.

9. A strip lighting device according to claim 8 wherein, on said engagement, the housing overlies said rail.

10. A strip lighting device according to claim 8 wherein said snap or sliding engagement is between longitudinally extending rib means on one of the rail and housing, and complementary groove means on the other of the rail and housing.

11. A strip lighting device according to claim 10 further including opposed longitudinal undercut formations in said groove means.

12. A strip lighting device according to claim 1 further comprising a face that provides a substantially planar real surface.

13. A strip lighting device according to claim 1 further comprising a connector to couple the housing to another similar strip lighting device.

14. A strip lighting device according to claim 13 wherein said connector permits said housing and said another similar strip lighting device to be relatively longitudinally displaced by thermal explosion or building subsidence, without being uncoupled.

15. A strip lighting device according to claim 14 wherein said connector comprises an integral molded body which defines a pair of generally tubular portions slidably engageable with the respective said housings so that their interiors are in communication within the connector, wherein said integral molded body further defines a relatively thin wall portion between said generally tubular portions, said thin wall portion being resiliently deformable to compensate for relative variations in the relative positions of the generally tubular portions.

16. A strip lighting device according to claim 15 wherein said integral molded body is in a material adopted to engage and sealingly grasp the respective said housings.

17. A strip lighting device according to claim 7 further including means to electrically and physically interconnect said circuit board strip to a similar circuit board strip of a similar device to which said device is coupled.

18. A strip lighting device according to claim 17 wherein said means to electrically and physically interconnect includes:

an integral molded body with features which define spaced generally parallel channels or passages open at their outer ends to receive respective end fingers of the respective said strips, whereby the strips are aligned and generally co-planar;

electrically conductive contact means in said channels or passages for engaging complementary contacts on said strips when said fingers are received in the channels;

means carried by said body electrically connecting each of the contact means for one strip carried by said body with one or more of the contact means for the other strip; and resiliently deformable means on said body for latching said body to each of said strips.

19. A strip lighting device according to claim 18 wherein said spaced channels are arranged along opposite sides of the integral molded body, and open laterally from the body.

20. A strip lighting device according to claim 18 wherein said resiliently deformable latch means is provided as a pair of deflectable tongue portions with lugs, which tongue portions are defined by slits in a web portion of the integral molded body.

21. A structure having one or more features highlighted or decorated by one or more strip lighting devices comprising:

an elongate housing comprising a hollow enclosure with at least one opening, wherein said elongate housing is at least partially translucent and is a single piece of material having one or more cavities to receive said light sources;

a plurality of light sources arranged at intervals within said hollow enclosure; and a fastener, separate from said elongate housing, for fastening said elongate housing to a surface;

wherein said housing overlies the plurality of light sources and diffuses, disperses, or scatters light emitted by the light sources such that individuals of the plurality of light sources are substantially not distinguishable when activated and viewed from outside said housing.

22. A structure according to claim 21 wherein said highlighted or decorated feature of the structure is a corner or edge.

23. A structure according to claim 22 wherein said edge is an edge of a roof, a window or a door, or a corner between respective wall or roof sections.

24. A structure according to claim 22 wherein said edge is a gable or ridge line of a building roof.

* * * * *